United States Patent [19]

Tomarin

[11] 4,396,653

[45] Aug. 2, 1983

[54] SIMULATED GRASS PLAYING FIELD SURFACE WITH RUBBER PARTICLE LAYER AND SAND LAYER

[76] Inventor: Seymour A. Tomarin, P.O. Box 730, 23 Smith St., St. Catharines, Ontario, Canada, L2R 6Y6

[21] Appl. No.: 422,759

[22] Filed: Sep. 24, 1982

[51] Int. Cl.[3] ..... B32B 3/02; B32B 33/00

[52] U.S. Cl. ..... 428/17; 428/85; 428/87; 428/92; 428/95; 428/96; 428/212; 428/323; 428/331

[58] Field of Search ..... 428/17, 85, 87, 92, 428/95, 96, 212, 323, 331

[56] References Cited

U.S. PATENT DOCUMENTS 4,044,179 8/1977 Haas ..... 428/17

4,336,286 6/1982 Tomarin ..... 428/17

*Primary Examiner*—Marion McCamish

*Attorney, Agent, or Firm*—Cullen, Sloman, Cantor, Grauer, Scott and Rutherford

[57] ABSTRACT

A playing field surface is formed of a synthetic fiber carpet, having generally upright pile fibers, upon which is applied a particulate covering. The covering is formed of a lower layer of resilient, rubber-like particles such as crumb rubber, and an upper layer of relatively coarse sand-like particles. A binder material may be used for binding together at least some of the rubber-like particles. The upper layer sand-like particles cooperate with the exposed upper end portions of the fibers to provide a simulated grass-like field surface. The relatively large sand-like particles resist excessive compacting of the covering as well as form a stabilizing cover for the layer of rubber-like particles which provide an inner resiliency to the field surface.

7 Claims, 4 Drawing Figures

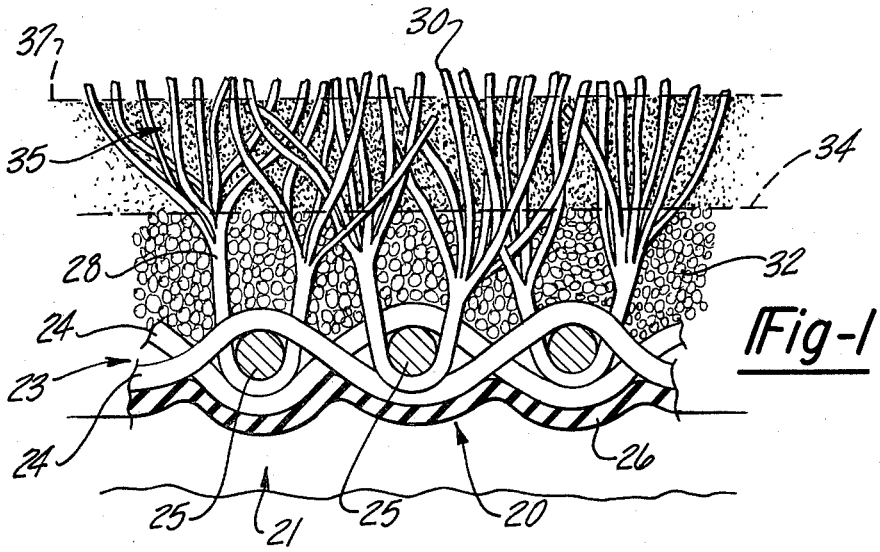
Fig-1
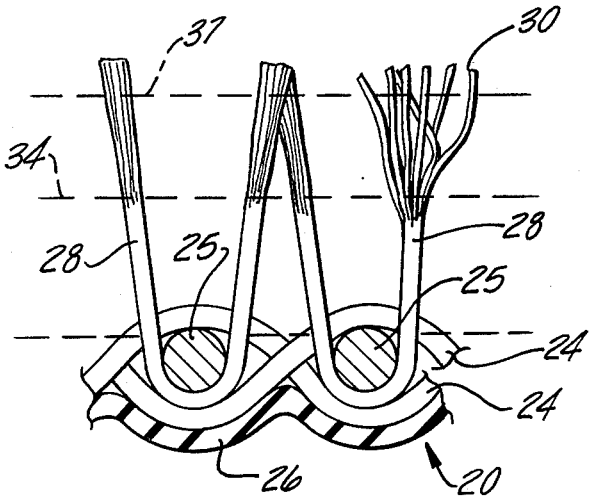
Fig-2
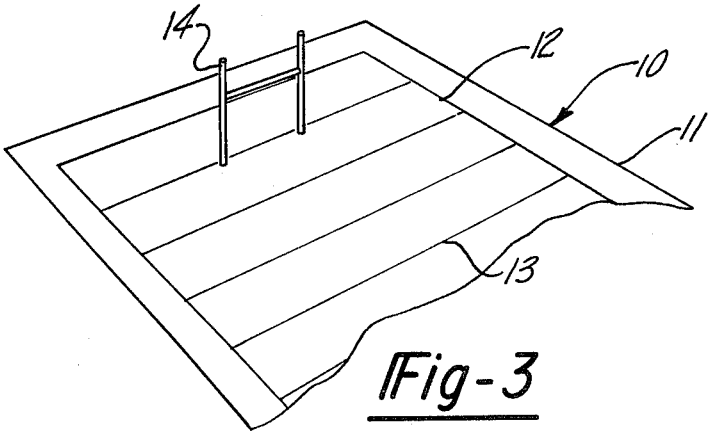
Fig-3
Fig-4
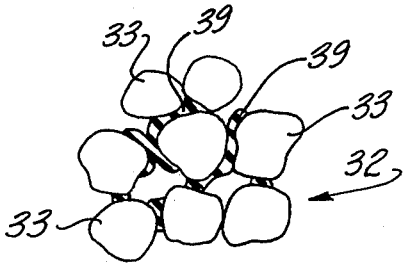

SIMULATED GRASS PLAYING FIELD SURFACE WITH RUBBER PARTICLE LAYER AND SAND LAYER

BACKGROUND OF INVENTION

The invention herein relates to a playing field surface useful for athletic games such as for tennis courts, football and soccer fields, baseball fields, field hockey playing fields, and the like. Such types of athletic game playing fields have been made of artificial turf or synthetic grass-like carpeting which simulate natural grass fields.

In the past, the artificial turf or simulated grass playing fields generally comprised a grass-like carpeting laid upon a base surface, such as the ground, sand, gravel and the like, appropriately drained and sloped for water drainage purposes. A filling of sand or other particulate or granular material has been applied upon the synthetic grass-like carpeting so that the composite carpet and covering or filler forms the playing surface. Examples of this type of construction are illustrated in my prior art patent, U.S. Pat. No. 4,336,286 issued June 22, 1982 and in the prior patents to Haas, U.S. Pat. No. 3,995,079 issued Nov. 30, 1976 and U.S. Pat. No. 4,044,179 issued Aug. 23, 1977.

In such types of playing field surfaces, it is desirable to have some small predetermined amount of resiliency which, depending upon the particular game, may be desirable for ball bouncing characteristics or for player feel, and the like. The degree and type of resiliency differ in various kinds of games and thus, are difficult to provide in this kind of surface construction. Thus, as illustrated in the above-identified patents, the typical way of providing some degree of resiliency has been to utilize rubber-like carpet bases or resilient underlays, but these are not sufficient for many desired game conditions.

Thus, this invention relates to an improvement in the simulated grass or synthetic turf playing field surfaces wherein a controlled amount of resiliency can be provided as desired.

SUMMARY OF INVENTION

The invention herein relates to the provision of a resilient layer formed of rubber-like particles upon the artificial turf or simulated grass carpeting and beneath a covering layer of relatively coarse sand type particles to produce a predetermined and controlled surface resiliency. With this arrangement, the covering particles stabilize the synthetic grass fibers in their upright positions and conversely, the synthetic fibers stabilize the particles against relative displacement and the layers of sand over rubber stabilize each other and intereact to give better playability to the surface.

The invention herein contemplates utilizing resilient rubber-like particles which are relatively hard or stiff and are of sand-like sizes, as contrasted with thick foam type or more resilient rubber as, for example, is utilized as a base for the carpet. Thus, the rubber-like particles act somewhat like the sand particles, but provide resiliency. A suitable form of such particles which is commercially available is what is called "crumb rubber" which is granulated or ground rubber tires which, of course, are normally formed of a synthetic rubber so that the term rubber contemplates the synthetic rubber normally used in automotive vehicle tires as well as natural rubber.

The rubber-like particles can be in the size range of roughly between about 10–70 mesh, depending upon desired firmness. The sand may be roughly in the range of 6–70 mesh. The composite coating may be approximately as high as the fibers or slightly lower than the height of the fibers to expose a short portion of the fibers tips. The layers may vary in thickness relative to each other, such as of equal thickness to where the sand to rubber ratio may be roughly between about 25–75 percent of the overall thickness or depth of the coating. The ratio may be varied to produce any desired degree of firmness.

As can be seen, an object of this invention is to provide an inexpensive, easily applied and maintained covering or coating for the artificial turf carpet to produce a playing field surface of preselected resiliency or firmness. This surface can be designed for a particular game and then reproduced at other locations for that same game. For example, a league of football teams can use a uniform, predetermined playing surface resiliency in all of the different fields used in the league.

Another object of this invention to utilize readily available, relatively inexpensive commercial materials which might otherwise be used as scrap to provide the desired rubber particle layers.

Still a further object of the invention is to form a rubber particle layer which can be further stabilized by applying a sufficient amount of a binder, such as a rubber cement or adhesive, to bind at least some of the adjacent particles together at the points where they are in close proximity The particles are otherwise free and relatively loose to provide water drainage passageways, as well as the particular resilient firmness desired for the field.

These and other objects and advantages of this invention will become apparent upon reading the following description, of which the attached drawings form a part.

DESCRIPTION OF DRAWINGS

FIG. 1 is an enlarged, cross-sectional view of a fragment of the playing field surface carpet, fibers and covering applied upon the ground.

FIG. 2 is an enlarged, fragmentary section showing the tuft arrangement of the carpeting.

FIG. 3 is a fragment of a football field, shown in perspective, to illustrate the utilization of the playing surface herein.

FIG. 4 is an enlarged, fragmentary view showing the rubber particles bonded together.

DETAILED DESCRIPTION

FIG. 3 illustrates a typical playing field surface 10, illustrated in the form of a football field. However, the field could be appropriately designed for any of the outdoor type athletic games, such as tennis, golf, soccer, field hockey, baseball and the like.

As illustrated in FIG. 3, the playing field includes appropriate boundary lines 11, side marker lines 12 and distance marker lines 13 with goal posts 14 or the equivalent as used in other games. Significantly, the lines can be permanently applied by using colored carpeting fibers for the line areas.

The playing field surface is made up of a synthetic grass or artificial turf carpet 20 which is of sufficient size and shape to make up the required field area. The carpet is laid upon a support base 21 which may be the bare ground or gravel or sand or combinations of these with stone or the like to provide a suitable support and drain arrangement. In some fields, it is conventional to tip or angle the carpet and the base support surface and to use drain pipes, for draining water so as to permit rapid drying of the surface after rain.

The support base and the particular form of carpet form no part of the present invention. However, by way of illustration, the carpet may be made of a base sheet 23 which may be woven out of warp type strands 24 and cross or woof type strands 25 to produce a woven sheet having its lower face coated with a rubber-type coating 26. Fiber tufts 28 are formed by double bending and interfitting the tufts through the woven strands of the carpet base sheet. These tufts may be of collections of individual fibers or they may be wide single strands whose ends split into the numerous, individual fibers 30.

The fiber tufts may vary considerably in size and thickness. Usually it is desired to keep the height of the fibers above the carpet sheet base in the range of about one-half inch to two and one-half inches with one inch, approximately, being in a generally satisfactory range for most sports. The tufts themselves may be formed of fibers that are roughly about 5,700 to 7,600 denier with the fibers each being wider than thick, as for example, one and one-half to two mils thick and about one-sixteenth inch in width to form a paper-thin narrow strip. These strips are somewhat resilient because made of synthetic plastics, such as polypropylene.

The tufts may be arranged close together, such as one-eighth of an inch apart in one direction and perhaps one-quarter of an inch apart in an opposite direction to form a tightly packed, dense network or mass of fibers which tend to intertwine. A suitable carpet formed in this manner may be in the range of roughly 24–36 ounces per square yard in weight.

The rubber coating arranged on the bottom surface of the carpeting may vary in thickness and may also be patterned, to form a tread or bead to better engage with the ground support base and prevent shifting of the carpet under the loads encountered in athletic movements. Once the carpet is laid upon the ground and leveled, the granular or particulate covering or coating is applied.

First, a layer of rubber-like particles is applied to the predetermined depth. The depth may be roughly on the order of 50 percent of the height of the fiber above the base sheet. However, the thickness or depth of the rubber particle layer may vary between about 25–75 percent of the length of the fiber, depending upon the desired resiliency of the surface.

The rubber particles may be made of either synthetic or natural rubber material. The material selected will depend in part upon cost, commercial availability, and durability. Also, the material should be sufficiently hard or solid to give a firm sand-like base but with sufficient resiliency that is preferred for a particular game. Preferably, the rubber particles are made of ground crumb rubber, which are generally of between about 10–30 mesh. However, smaller diameter particles can also be used such as in the range of 30–70 mesh, depending upon the firmness required in the surface. These mesh sizes are not critical, but rather are approximate since crumb rubber itself, is not a precise material as it is formed of ground, scrap rubber tires.

After the application of the rubber-like particles 33 is completed to form the lower layer 32 to the height required, as schematically shown by the dotted line 34 in FIGS. 1 and 2, the upper layer 35 is applied. This upper layer is formed of sand-like particles, preferably dry silica sand in the general range of between about 6–70 mesh. For many uses, it is preferred to use sand particles in the larger size, such as in the range of between about 6–40 mesh. Since the larger mesh size grains of sand should not compact as firmly as do the smaller size grains they provide a better surface for absorbing ball impacts.

The sand upper layer combines with the exposed tips of the fibers to simulate a natural grass field appearance and playability. In addition, the upper layer acts as a cover or cap on the granulated rubber particles to keep these in place. The sand layer may be to the full height of the fibers or in most cases, shortly below the full height as indicated by the dotted line 37 in FIGS. 1 and 2.

The rubber-like particles and the sand particles, along with the intertwined fibers tend to mutually stabilize and hold each other in predetermined position. However, in some instances, it is desired to hold the rubber-like binder together even more, particularly to prevent any shifting in a high impact area. Thus, a binder material 39 may be added to the rubber-like particles, as illustrated in FIG. 4. Preferably, the binder, which may be in the form of suitable, commercially available rubber adhesives or cements, is sprayed or spilled upon the lower layer so as to trickle down between and connect adjacent particle surfaces. Preferably the binder does not fill the spaces between the particles, but rather merely serves to tack adjacent portions of particles surfaces to one another. This forms a porous material in which at least some, but not necessarily all, of the particles are spot fastened together.

The impact absorbing properties and the playing characteristics, e.g., the bounce of a ball and the like, produced by surfaces made in accordance with this invention may be controllably varied by varying the heights of either or both of the two layers. Once the surface is completed to desired conditions, maintenance is relatively easy. For example, additional sand may be applied as necessary. Significantly, the surface tends to rapidly drain when water is applied thereon, such as following a rainstorm, because of the relatively porous lower layer.

Having fully described an operative embodiment of this invention, I now claim:

1. In a playing field surface formed of a synthetic pile carpet which is laid upon a base support surface, and has a base sheet with densely arranged upstanding grass simulating synthetic fibers in the general range of between about one-half to two and one-half inches in height above the base sheet, and including a uniform thickness particulate coating covering the base sheet and of a pre-selected height ranging between the full height of the fibers to a short distance below the full fiber height for exposing the tips of the free ends of the fibers so that the coating generally fills the spaces between the fibers to provide an exposed surface which simulates a natural grass and ground surface, the improvement comprising:

said particulate covering being divided into an upper layer and a lower layer;

the lower layer being formed of relatively resilient particles of a rubber-like material and being of substantial height relative to the overall height of the fibers;

and the upper layer being formed of relatively coarse sand-like particles for covering the lower layer and also being of substantial height relative to the overall height of the fibers;

whereby the layers and fibers cooperate to provide a natural grass surface appearance, feel and playability and for stabilizing the positions of the layer particles and fibers.

2. In a playing field surface as defined in claim 1, and said lower layer being formed of a height between about 25 to 75 percent of the fiber lengths and the rubber-like particles being generally in the range of between about 10–70 mesh.

3. In a playing field surface as defined in claim 2, and said sand-like particles being generally in the range of between about 6–70 mesh.

4. In a playing field surface as defined in claim 2, and said lower layer being formed of ground crumb rubber.

5. In a playing field surface as defined in claim 1, and said lower layer being formed of ground crumb rubber generally of a size of between about 10–70 mesh, and with the layer being approximately 25–75 percent of the length of the fibers, with the upper layer formed of sand which is generally of a size of between about 6–70 mesh.

6. In a playing field surface as defined in claim 1, and said lower layer being formed of coarse ground crumb rubber generally of a size of between about 10–30 mesh, and with the layer being roughly about 50 percent of the depth of the covering;

with the upper layer formed of sand which is generally of the size of between about 6–40 mesh and comprising roughly the remaining 50 percent depth of the covering.

7. In a playing field surface as defined in any one of claims 1, 3 or 5 above, and including a binding material securing together at least some of the rubber-like particles at their adjacent surface portions, with the particles being otherwise free and relatively loose.

* * * * *